US010989025B2

(12) United States Patent
Ejim et al.

(10) Patent No.: US 10,989,025 B2
(45) Date of Patent: Apr. 27, 2021

(54) PREVENTION OF GAS ACCUMULATION ABOVE ESP INTAKE

(71) Applicant: Saudi Arabian Oil Company, Dhahran (SA)

(72) Inventors: Chidirim Enoch Ejim, Dammam (SA); Jinjiang Xiao, Dhahran (SA); Rafael Adolfo Lastra, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 15/466,376

(22) Filed: Mar. 22, 2017

(65) Prior Publication Data

US 2018/0274343 A1 Sep. 27, 2018

(51) Int. Cl.

| | |
|---|---|
| ***E21B 43/12*** | (2006.01) |
| ***E21B 33/12*** | (2006.01) |
| ***E21B 47/008*** | (2012.01) |
| ***E21B 47/06*** | (2012.01) |
| ***E21B 47/07*** | (2012.01) |

(52) U.S. Cl.

CPC ..... *E21B 43/128* (2013.01); *E21B 33/12* (2013.01); *E21B 47/008* (2020.05); *E21B 47/06* (2013.01); *E21B 47/07* (2020.05)

(58) Field of Classification Search

CPC .... E21B 33/12; E21B 43/128; E21B 33/1246; E21B 47/0007; E21B 47/065; E21B 33/1272

See application file for complete search history.

(56) References Cited

U.S. PATENT DOCUMENTS

| | | | | |
|---|---|---|---|---|
| 4,125,162 | A * | 11/1978 | Groves, Sr. | E21B 19/22 166/368 |
| 4,637,468 | A * | 1/1987 | Derrick | E21B 33/1294 166/133 |
| 6,119,780 | A | 9/2000 | Christmas | |
| 6,138,765 | A | 10/2000 | Russell et al. | |
| 6,602,059 | B1 | 8/2003 | Howell et al. | |
| 7,828,059 | B2 * | 11/2010 | Reid | E21B 33/12 166/105.5 |
| 7,882,896 | B2 | 2/2011 | Wilson et al. | |
| 8,297,345 | B2 * | 10/2012 | Emerson | H01R 13/5208 166/65.1 |
| 8,448,699 | B2 | 5/2013 | Camilleri et al. | |
| 8,571,798 | B2 | 10/2013 | Atherton | |

(Continued)

OTHER PUBLICATIONS

International Search Report and Written Opinion for related PCT application PCT/US2018/023756 dated Jun. 6, 2018.

*Primary Examiner* — D. Andrews
*Assistant Examiner* — Manuel C Portocarrero
(74) *Attorney, Agent, or Firm* — Bracewell LLP; Constance G. Rhebergen; Linda L. Morgan

(57) ABSTRACT

A system for producing hydrocarbons from a subterranean well includes an electrical submersible pump assembly with a pump, intake, protector, and motor. A production tubing is in fluid communication with the electrical submersible pump assembly and has an inner bore sized to deliver fluids from the electrical submersible pump assembly to a wellhead assembly. A packer assembly is located between the pump and the intake, the packer assembly moveable to an expanded position with an outer diameter in sealing engagement with an inner diameter of an outer tubular member.

21 Claims, 3 Drawing Sheets

(56) References Cited

U.S. PATENT DOCUMENTS

| | | | | |
|---|---|---|---|---|
| 8,727,016 | B2 | 5/2014 | Noui-Mehidi et al. | |
| 2007/0289747 | A1 | 12/2007 | Shaw et al. | |
| 2009/0047157 | A1 | 2/2009 | Reid et al. | |
| 2009/0056939 | A1* | 3/2009 | Hackworth | E21B 43/385 166/265 |
| 2009/0065202 | A1 | 3/2009 | Brown et al. | |
| 2009/0202371 | A1* | 8/2009 | Green | E21B 43/128 417/423.3 |
| 2011/0024123 | A1 | 2/2011 | Brown et al. | |
| 2012/0181049 | A1* | 7/2012 | Tingler | E21B 33/1208 166/387 |
| 2016/0222770 | A1 | 8/2016 | Kirk et al. | |
| 2016/0273535 | A1 | 9/2016 | Ejim et al. | |

* cited by examiner

PREVENTION OF GAS ACCUMULATION ABOVE ESP INTAKE

BACKGROUND OF THE DISCLOSURE

1. Field of the Disclosure

The disclosure relates generally to electrical submersible pumps and in particular, to electrical submersible pump assemblies that reduce gas accumulation above fluid intakes.

2. Description of the Related Art

One method of producing hydrocarbon fluid from a well bore that lacks sufficient internal pressure for natural production is to utilize an artificial lift method such as an electrical submersible pump (ESP). A string of tubing or pipe known as a production string suspends the submersible pumping device near the bottom of the well bore proximate to the producing formation. The submersible pumping device is operable to retrieve production zone fluid, impart a higher pressure to the fluid and discharge the pressurized production zone fluid into production tubing. Pressurized well bore fluid rises towards the surface motivated by difference in pressure. Electrical submersible pumps can be useful, for example, in high gas/oil ratio operations and in aged fields where there is a loss of energy and the hydrocarbons can no longer reach the surface naturally.

Some current electrical submersible pumps are supported by cables or tubing within the well and the production fluids are produced to a wellhead at the surface through the annular space between an outer diameter of the cables or tubing and an inner diameter of an outer tubular member, which can be known as the tubing casing annulus. The outer tubular member can be, for example, well casing or other large diameter well tubing. However, in order to protect the integrity of the outer tubular member, for example to prevent corrosive gases or other fluids from contacting the inner surfaces of the outer tubular member, it can be preferable for production fluids to instead be produced to the surface through a production tubular. In addition, some regulations may restrict the use of the tubing casing annulus for the delivery of production fluids to the surface.

In some current electrical submersible pump assemblies that produce fluids through production tubing, a packer can be set a couple hundred feet above the electrical submersible pump assembly discharge. In such designs, the electric power cable from the surface is connected to the packer via a packer penetrator at the top side of the packer. The motor lead extension from the motor downhole is connected to a packer penetrator at the bottom side of the packer. These connections provide a continuous line for the electrical power required by the downhole motor to drive the rotating components of the electrical submersible pump assembly. However, the accumulation of gas below the packer can be detrimental to the electrical connectors, for example with corrosive gases such as $H_2S$. The exposure to these gases often results in failures at the packer penetrator, cable splices or the motor lead extension that are located at the packer. This is a particular concern, for example, in operations, where production is required such that the flowing bottomhole pressure falls below the bubble point pressure and free gas is formed due to dissolved gas in the liquid (such as oil or water) breaking out. Due to the lower density of the free gas compared to the liquid, the gas pockets rise above the intake and are trapped just under the packer. If the amount of free gas causes the gas column to reach the intake, the efficiency of the pump can be significantly reduced. If the gas completely fills the impeller passages, the pump can become gas locked and fail.

A current proposed solution to such problems has been the use of a shrouded electrical submersible pump system where the intake, protector, and motor are placed within a pod system and connected to a stinger. The stinger latches into a packer situated below the pod system. Well fluid from the reservoir enters the stinger and pod system and flows to the top of the pod system, where the intake is located. The fluid enters the pump and is pumped to the surface per conventional methods. However, such systems require new specialized components such as a pod, shroud hanger, stinger, and others, that need to be incorporated into the equipment assembly. These additional specialized components increase the overall cost of the assembly. Furthermore, in using a pod system, the fluid velocity at entry into the stinger increases due to the relatively smaller cross-sectional area compared to the tubing casing annulus. The higher fluid velocity reduces the pressure at this location. This additional pressure loss can trigger additional gas breakout within the pod system.

SUMMARY OF THE DISCLOSURE

Embodiments disclosed herein provide systems and methods for providing the electrical submersible pump packer in such a way that the pump intake is located adjacent to and below the packer and the pump stages are located above the packer. This configuration reduces or eliminates pump gas lock as a result of free gas and also reduces or prevents electrical failures related to corrosive gas attacks on cables and connectors.

In an embodiment of this application, a system for producing hydrocarbons from a subterranean well includes an electrical submersible pump assembly with a pump, intake, protector, and motor. Production tubing is in fluid communication with the electrical submersible pump assembly and has an inner bore sized to deliver fluids from the electrical submersible pump assembly to a wellhead assembly. A packer assembly is located between the pump and the intake, the packer assembly moveable to an expanded position with an outer diameter in sealing engagement with an inner diameter of an outer tubular member.

In alternate embodiments, the pump can be adjacent to the intake, the intake can be located between the pump and the protector, the protector can be located between the intake and the motor, and the motor can be located further within the subterranean well than the pump. The electrical submersible pump assembly can further include a monitoring sub, the monitoring sub being located at a lower end of the motor. The electrical submersible pump assembly can be suspended from, and supported by, the production tubing. The motor can be located downstream of perforations through the outer tubular member so that fluids flowing through the perforations pass the motor before entering the intake.

In other alternate embodiments, the packer assembly can be a separate element from the submersible pump assembly. The packer assembly can include an upper flange connection that is secured to the pump and a lower flange connection that is secured to the intake, and wherein a sealing element of the packer assembly circumscribes the upper flange connection and the lower flange connection. Alternately, the packer assembly can include a packer seat that is integrally formed with one of the pump and the intake, and a sealing element of the packer assembly can circumscribe the packer seat. A bottom surface of the packer assembly can be adjacent to the intake.

In other alternate embodiments of this disclosure, a system for producing hydrocarbons from a subterranean well includes an electrical submersible pump assembly with a pump, intake, protector, and motor, wherein the pump is adjacent to the intake, the intake is located between the pump and the protector, the protector is located between the intake and the motor, and the motor is located further within the subterranean well than the pump. Production tubing suspends the electrical submersible pump assembly within the subterranean well and has an inner bore sized to deliver fluids from the electrical submersible pump assembly to a wellhead assembly. A packer assembly is located between the pump and the intake, the packer assembly having an outer diameter in sealing engagement with an inner diameter of an outer tubular member.

In alternate embodiments the packer assembly can be a separate element from the submersible pump assembly. The packer assembly can include an upper flange connection that is secured to the pump and a lower flange connection that is secured to the intake, and a sealing element of the packer assembly can circumscribe the upper flange connection and the lower flange connection. Alternately, the packer assembly can include a packer seat that is integrally formed with one of the pump and the intake, and a sealing element of the packer assembly can circumscribe the packer seat. The motor can be located upstream of perforations through the outer tubular member so that fluids flowing through the perforations pass the motor before entering the intake. The electrical submersible pump assembly can further include a monitoring sub, the monitoring sub being located at a lower end of the motor.

In another alternate embodiment of this disclosure, a method for producing hydrocarbons from a subterranean well includes providing an electrical submersible pump assembly with a pump, intake, protector, and motor. Production tubing is secured in fluid communication with the electrical submersible pump assembly. A packer assembly is located between the pump and the intake. The packer assembly is moved to an expanded position so that an outer diameter of the packer assembly is in sealing engagement with an inner diameter of an outer tubular member. Fluids are delivered from the electrical submersible pump assembly to a wellhead assembly through an inner bore of the production tubing.

In alternate embodiments, the pump can be adjacent to the intake, the intake can be located between the pump and the protector, the protector can be located between the intake and the motor, and the motor can be located further within the subterranean well than the pump. The electrical submersible pump can be suspended within the subterranean well with the production tubing. The electrical submersible pump assembly can be lowered into the well so that the motor is downstream of perforations through the outer tubular member so that fluids flowing through the perforations pass the motor before entering the intake.

In other alternate embodiments, the packer assembly can be a separate element from the submersible pump assembly with an upper flange connection and a lower flange connection and a sealing element of the packer assembly can circumscribe the upper flange connection and the lower flange connection. The method can further comprise securing the upper flange connection to the pump and securing the lower flange connection to the intake. The packer assembly can alternately include a packer seat that is integrally formed with one of the pump and the intake, and the method can further comprise circumscribing the packer seat with a sealing element of the packer assembly. A bottom surface of the packer assembly can be adjacent to the intake.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
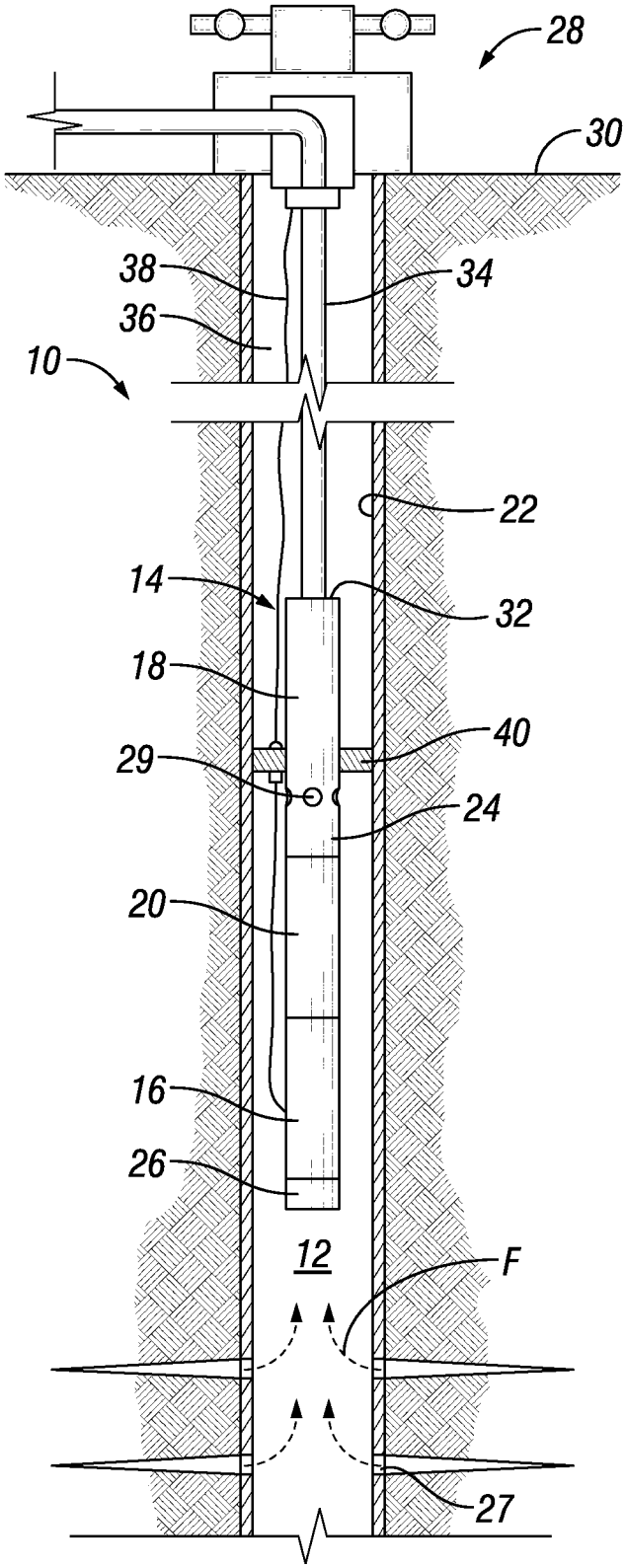
FIG. 1 is a section view of a subterranean well having an electrical submersible pump assembly, in accordance with an embodiment of this disclosure.

Looking at FIG. 1, a system for producing hydrocarbons from subterranean well 10 is shown. Subterranean well 10 includes wellbore 12. Electrical submersible pump assembly 14 is located within wellbore 12. Wellbore 12 can include outer tubular member 22, which can be, for example, a well casing or other large diameter well tubing. Electrical submersible pump assembly 14 of FIG. 1 includes motor 16 at or near the lowermost end of electrical submersible pump assembly 14. Motor 16 is used to drive a pump 18 at an upper portion of electrical submersible pump assembly 14. Between motor 16 and pump 18 is protector 20 and intake 24. Protector 20 can be used for equalizing pressure within electrical submersible pump assembly 14 with that of wellbore 12, for providing a seal between intake 24 and motor 16, for containing an oil reservoir for motor 16, and for helping to convey the thrust load of pump 18.

A monitoring sub such as sensor 26 can be included in electrical submersible pump assembly 14 as an optional element. In the example embodiment of FIG. 1, sensor 26 is located at a lower end of motor 16. Sensor 26 can gather and provide data relating to operations of electrical submersible pump assembly 14 and conditions within wellbore 12. As an example, sensor 26 can monitor and report pump 18 intake pressure and temperature, pump 18 discharge pressure and temperature, motor 16 oil and motor 16 winding temperature, vibration of electrical submersible pump assembly 14 in multiple axis, and any leakage current of motor 16 of electrical submersible pump assembly 14.

In embodiments of this disclosure, pump 18 is adjacent to intake 24, intake 24 is located between pump 18 and protector 20, protector 20 is located between intake 24 and motor 16, and motor 16 is located further within subterranean well 10 than pump 18. Therefore, from top to bottom the elements are ordered: pump 18, intake 24, protector 20, and motor 16.

Well fluid F is shown entering wellbore 12 from a formation adjacent wellbore 12 through perforations 27. Well fluid F for production flows to opening 29 of intake 24. Because the cross sectional area through which well fluid F travels from perforations 27 to intake 24 is not reduced to a small diameter bore, the fluid velocity is not significantly increased and the pressure of well fluid F is not significantly decreased and the potential for gas breakout is lower than systems that utilize, for example, stingers upstream of intake 24.

Well fluid F is pressurized by pump 18, is discharged out of pump 18 at discharge 32, and travels up to wellhead assembly 28 at surface 30 through production tubing 34. Production tubing 34 is in fluid communication with electrical submersible pump assembly 14 and has an inner bore sized to deliver well fluids F from electrical submersible pump assembly 14 to wellhead assembly 28. Electrical submersible pump assembly 14 is positioned within wellbore 12 so that motor 16 is located downstream of perforations 27 through the outer tubular member 22 so that well fluids F flowing through perforations 27 pass motor 16 before entering intake 24. This helps to cool motor 16 with well fluid F.

Electrical submersible pump assembly 14 is suspended from, and supported by, production tubing 34. Production tubing 34 is an elongated tubular member that extends within subterranean well 10. Production tubing 34 can be formed of carbon steel material, carbon fiber tube, or other types of corrosion resistance alloys or coatings.

Because well fluid F is produced through production tubing 34, there is no outlet releasing fluids within electrical submersible pump assembly 14 back into wellbore 12 and well fluids F are not produced through the tubing casing annulus 36. Tubing casing annulus 36 is an annular space located between an outer diameter of production tubing 34 and an inner diameter of outer tubular member 22.

Power cable 38 extends through wellbore 12 alongside production tubing 34. Power cable 38 can provide the power required to operate motor 16 of electrical submersible pump assembly 14. Power cable 38 extends to packer assembly 40 and can be connected to packer assembly 40 with a packer penetrator at the top side of packer assembly 40. Power cable 38 can then extend between packer assembly 40 and motor 16 with a motor lead extension. The motor lead extension can be connected to a packer penetrator at the bottom side of packer assembly 40. Power cable 38 can be a suitable power cable for powering an electrical submersible pump assembly 14, known to those with skill in the art.

Figure 2:
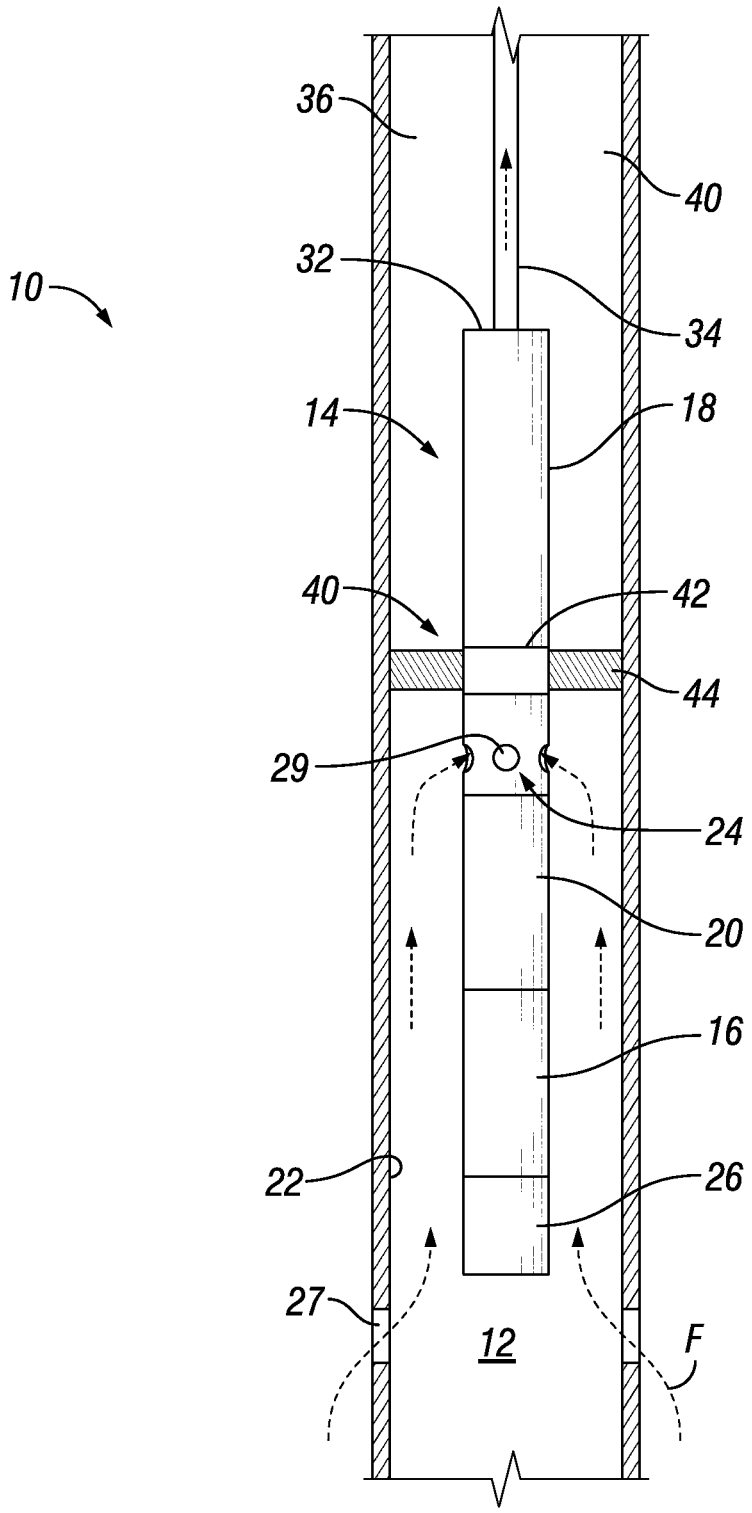
FIG. 2 is a section view of an electrical submersible pump assembly, in accordance with an embodiment of this disclosure.
Figure 3:
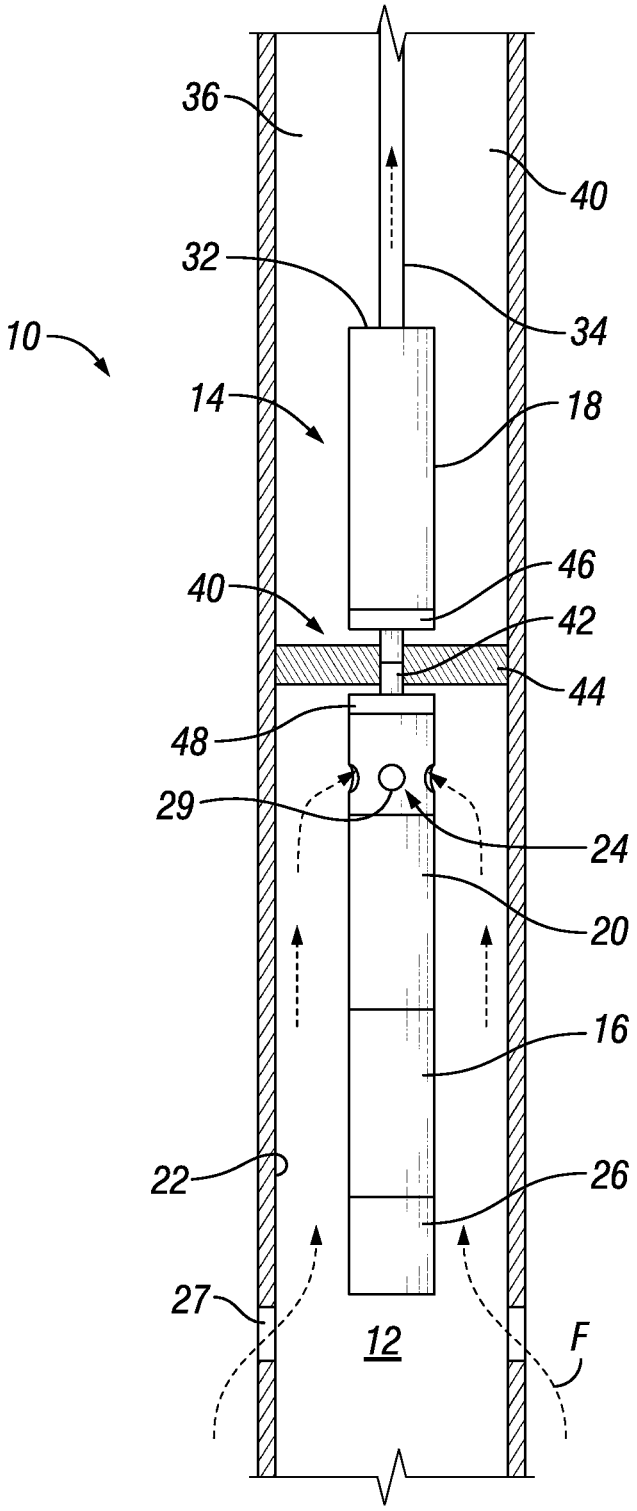
FIG. 3 is a section view of an electrical submersible pump assembly, in accordance with an embodiment of this disclosure.

Looking at FIGS. 2-3, packer assembly 40 is located between pump 18 and intake 24. Packer assembly 40 can be in a contracted position when lowering packer assembly 40 into wellbore 12. In the contracted position, an outer diameter of packer assembly is spaced apart from the inner diameter of outer tubular member 22. Packer assembly 40 is moveable to an expanded position so that the outer diameter of packer assembly 40 is in sealing engagement with the inner diameter of outer tubular member 22.

Packer assembly 40 includes packer seat 42 and sealing element 44. Sealing element 44 circumscribes packer seat 42. Sealing element 44 of packer assembly 40 can be a traditional packer member known in the art and set in a typical way. Packer assembly 40 is retrievable with electrical submersible pump assembly 14 so that as electrical submersible pump assembly 14 is pulled out of subterranean well 10 with production tubing 34, packer assembly 40 will remain secured to electrical submersible pump assembly 14. Packer assembly 40 can be designed to contain the pressures of wellbore 12 so that packer assembly 40 is a high pressure mechanical barrier.

In the embodiment of FIG. 2, packer assembly 40 can be integrally formed with electrical submersible pump assembly 14. Packer seat 42 can be integrally formed with pump 18 or with intake 24. In the alternate embodiment of FIG. 3, packer assembly 40 is a separate element from electrical submersible pump assembly 14. In such an embodiment, packer assembly 40 can include upper flange connection 46 that is secured to pump 18 and lower flange connection 48 that is secured to intake 24. Upper flange connection 46 and lower flange connection 48 define packer seat 42. Sealing element 44 of packer assembly 40 circumscribes upper flange connection 46 and lower flange connection 48. Upper flange connection 46 and lower flange connection 48 can have coupling components that allow Upper flange connection 46 and lower flange connection 48 to be secured to a currently available pump 18 and intake 24 so that a specially designed electrical submersible pump assembly 14 is not required. This will reduce both the lead time and the cost of the electrical submersible pump assembly 14 compared to specially designed electrical submersible pump assembly 14.

Looking at FIGS. 2-3, a bottom surface of packer assembly 40 is adjacent to intake 24. Because of the proximity of opening 29 of intake 24 to the bottom surface of packer assembly 40, as well fluid F travels up wellbore 12 from perforations 27, gases within well fluid F will stay mixed with liquid components of well fluid F and both the gases and liquids will enter intake 24 together to be produced through production tubing 34. The distance between the bottom surface of packer assembly 40 and opening 29 of intake 24 is sufficiently small that gases within well fluid F will not become trapped at the bottom surface of packer assembly 40. If any gases do separate from liquid and begin to gather at the bottom surface of packer assembly 40, eddies and current of well fluid F will cause such gases to be carried with well fluid F into intake 24.

In an example of operation, production tubing 34 can support electrical submersible pump assembly 14 and be used to lower electrical submersible pump assembly 14 into wellbore 12. Electrical submersible pump assembly 14 can be lowered into subterranean well 10 to a final position where motor 16 is downstream of perforations 27 through outer tubular member 22. Packer assembly 40 can be moved in a traditional manner to an expanded position so that an outer diameter of packer assembly 40 is in sealing engagement with an inner diameter of outer tubular member 22. Well fluids F can be artificially lifted with electrical submersible pump assembly 14 and produced through production tubing 34. Gas within well fluids F will enter intake 24 with liquids of well fluids F, reducing gas locking of pump 18, increasing the efficiency of pump 18, and reducing potential damage or failure of electrical submersible pump assembly 14. If electrical submersible pump assembly 14 has to be pulled out for any reason, electrical submersible pump assembly 14 can be retrieved safely with production tubing 34.

Therefore, as disclosed herein, embodiments of the systems and methods of this disclosure will prevent the accumulation of gas at a bottom side of packer assembly 40. The free gas is instead kept mixed with the liquid components of well fluid F, reducing the degradation of electrical and mechanical components in the region of packer assembly 40, and increasing the reliability of electrical submersible pump assembly 14. Systems and methods of this disclosure can be utilized with currently available electrical submersible pump assembly 14 components and can reduce the overall life cycle costs of the electrical submersible pump assembly 14 and prevent deferred production costs.

Embodiments of the disclosure described herein, therefore, are well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for producing hydrocarbons from a subterranean well, the system including:

an electrical submersible pump assembly with a pump, an intake, a protector, and a motor, wherein the pump is located uphole of the intake, the intake is located between the pump and the protector, the protector is located between the intake and the motor, and the motor is located further within the subterranean well than the pump;

production tubing in fluid communication with the electrical submersible pump assembly and having an inner bore sized to deliver fluids from the electrical submersible pump assembly to a wellhead assembly;

a packer seat located between the pump and the intake, the packer seat having an uphole end secured downhole of the pump and a downhole end secured uphole of the intake;

a packer assembly located between the pump and the intake, the packer assembly moveable to an expanded position with an outer diameter of a sealing element of the packer assembly in sealing engagement with an inner diameter of an outer tubular member, where the sealing element of the packer assembly circumscribes the packer seat; and a power cable extending to a packer penetrator at an uphole side of the packer assembly and a motor lead extension extending between the packer penetrator at a downhole side of the packer assembly and the motor.

2. The system of claim 1, wherein the electrical submersible pump assembly further includes a monitoring sub, the monitoring sub being located at a lower end of the motor.

3. The system of claim 1, wherein the electrical submersible pump assembly is suspended from, and supported by, the production tubing.

4. The system of claim 1, wherein the packer assembly is a separate element from the electrical submersible pump assembly.

5. The system of claim 4, wherein the packer assembly includes an upper flange connection that is secured to the pump and a lower flange connection that is secured to the intake, where the upper flange connection and the lower flange connection define the packer seat, and wherein a sealing element of the packer assembly circumscribes the upper flange connection and the lower flange connection.

6. The system of claim 1, wherein the packer seat is integrally formed with one of the pump and the intake.

7. The system of claim 1, wherein a bottom surface of the packer assembly is adjacent to the intake.

8. The system of claim 1, wherein the motor is located downstream of perforations through the outer tubular member so that the fluids flowing through the perforations pass the motor before entering the intake.

9. A system for producing hydrocarbons from a subterranean well, the system including:

an electrical submersible pump assembly with a pump, an intake, a protector, and a motor, wherein the pump is located uphole of the intake, the intake is located between the pump and the protector, the protector is located between the intake and the motor, and the motor is located further within the subterranean well than the pump;

production tubing suspending the electrical submersible pump assembly within the subterranean well and having an inner bore sized to deliver fluids from the electrical submersible pump assembly to a wellhead assembly;

a packer seat located between the pump and the intake, the packer seat having an uphole end secured downhole of the pump and a downhole end secured uphole of the intake;

a packer assembly located between the pump and the intake, the packer assembly having an outer diameter of a sealing element of the packer assembly in sealing engagement with an inner diameter of an outer tubular member, where the sealing element of the packer assembly circumscribes the packer seat; and a power cable extending to a packer penetrator at an uphole side of the packer assembly and a motor lead extension extending between the packer penetrator at a downhole side of the packer assembly and the motor.

10. The system of claim 9, wherein the packer assembly is a separate element from the electrical submersible pump assembly.

11. The system of claim 10, wherein the packer assembly includes an upper flange connection that is secured to the pump and a lower flange connection that is secured to the intake, where the upper flange connection and the lower flange connection define the packer seat, and wherein a sealing element of the packer assembly circumscribes the upper flange connection and the lower flange connection.

12. The system of claim 9, wherein the packer seat is integrally formed with one of the pump and the intake.

13. The system of claim 9, wherein the motor is located downstream of perforations through the outer tubular member so that the fluids flowing through the perforations pass the motor before entering the intake.

14. The system of claim 9, wherein the electrical submersible pump assembly further includes a monitoring sub, the monitoring sub being located at a lower end of the motor.

15. A method for producing hydrocarbons from a subterranean well, the method including:

providing an electrical submersible pump assembly with a pump, an intake, a protector, a motor, and a packer seat located between the pump and the intake, the packer seat having an uphole end secured downhole of the pump and a downhole end secured uphole of the intake, wherein the pump is located uphole of the intake, the intake is located between the pump and the protector, the protector is located between the intake and the motor, and the motor is located further within the subterranean well than the pump;

securing production tubing in fluid communication with the electrical submersible pump assembly;

locating a packer assembly between the pump and the intake and circumscribing the packer seat with a sealing element of the packer assembly;

extending a power cable to a packer penetrator at an uphole side of the packer assembly and extending a motor lead extension between the packer penetrator at a downhole side of the packer assembly and the motor;

moving the packer assembly to an expanded position so that an outer diameter of the sealing element of the packer assembly is in sealing engagement with an inner diameter of an outer tubular member; and delivering fluids from the electrical submersible pump assembly to a wellhead assembly through an inner bore of a production tubing.

16. The method of claim 15 further comprising suspending the electrical submersible pump assembly within the subterranean well with the production tubing.

17. The method of claim 15, wherein the packer assembly is a separate element from the electrical submersible pump assembly with an upper flange connection and a lower flange connection, where the upper flange connection and the lower flange connection define the packer seat and wherein a sealing element of the packer assembly circumscribes the upper flange connection and the lower flange connection, the method further comprising securing the upper flange connection to the pump and securing the lower flange connection to the intake.

18. The method of claim 15, wherein the packer seat is integrally formed with one of the pump and the intake.

19. The method of claim 15, wherein a bottom surface of the packer assembly is adjacent to the intake.

20. The method of claim 15, further comprising lowering the electrical submersible pump assembly into the subterranean well so that the motor is downstream of perforations through the outer tubular member so that the fluids flowing through the perforations pass the motor before entering the intake.

21. A system for producing hydrocarbons from a subterranean well, the system including:

an electrical submersible pump assembly with a pump, an intake, a protector, and a motor, wherein the pump is located uphole of the intake, the intake is located between the pump and the protector, the protector is located between the intake and the motor, and the motor is located further within the subterranean well than the pump;

production tubing in fluid communication with the electrical submersible pump assembly and having an inner bore sized to deliver fluids from the electrical submersible pump assembly to a wellhead assembly;

a packer seat located between the pump and the intake, the packer seat having an uphole end directly secured to the pump and a downhole end directly secured to the intake, the packer seat having an upper flange connection that is secured to the pump and a lower flange connection that is secured to the intake;

a packer assembly located between the pump and the intake, the packer assembly moveable to an expanded position with an outer diameter of a sealing element of the packer assembly in sealing engagement with an inner diameter of an outer tubular member, where the sealing element of the packer assembly circumscribes the upper flange connection and the lower flange connection of the packer seat; and a power cable extending to a packer penetrator at an uphole side of the packer assembly and a motor lead extension extending between the packer penetrator at a downhole side of the packer assembly and the motor.

* * * * *